US006916260B1

(12) United States Patent
Poteet

(10) Patent No.: US 6,916,260 B1
(45) Date of Patent: Jul. 12, 2005

(54) TENNIS RACKET GRIP DEVICE

(76) Inventor: Joyce Poteet, 4056 Cascade Falls Dr., Sarasota, FL (US) 34243

( * ) Notice: Subject to any disclaimer, the term of this patent is extended or adjusted under 35 U.S.C. 154(b) by 0 days.

(21) Appl. No.: 10/617,478

(22) Filed: Jul. 11, 2003

(51) Int. Cl.[7] ..... A63B 49/00
(52) U.S. Cl. ..... 473/551
(58) Field of Search ..... 473/549, 551, 473/553, 463, 300, 301, 302, 303, 568

(56) References Cited

U.S. PATENT DOCUMENTS 2,091,458 A * 8/1937 Sleight ..... 16/421
3,817,521 A * 6/1974 Wright ..... 473/551
3,860,243 A 1/1975 Prisco, Sr.
4,072,311 A * 2/1978 Bertucci ..... 473/551
4,402,508 A * 9/1983 Pflueger ..... 473/551
4,599,920 A 7/1986 Schmid
5,018,734 A 5/1991 Allsop
5,180,165 A 1/1993 Frost
5,595,544 A * 1/1997 Roelke ..... 473/203
6,017,283 A * 1/2000 Hagey ..... 473/551
6,305,051 B1 * 10/2001 Cho ..... 16/430

* cited by examiner

*Primary Examiner*—Raleigh W. Chiu
(74) *Attorney, Agent, or Firm*—Charles J. Prescott

(57) ABSTRACT

A tennis racket hand-positioning device attachable to a handle of a tennis racket. In one embodiment, a saddle shaped support member including an elongated thin attaching strip connected to and extending in spaced relation along a reverse surface of the support member. The attaching strip is adapted in width and thickness to be supportively engaged beneath a turn of handle grip wrap of the handle and against the top right bevel of the handle to support a selected position and orientation of the support member. Felt orientation indicia against the base of the thumb adjacent the palm of the user then advises of the preselected reorientation of a head of the tennis racket during a backhand stroke. Another embodiment provides support against the palm of the hand during backhand strokes and a third embodiment also provides both felt indicia and a physical stop against the base of the thumb to achieve proper preselected racket reorientation during a backhand stroke.

13 Claims, 7 Drawing Sheets

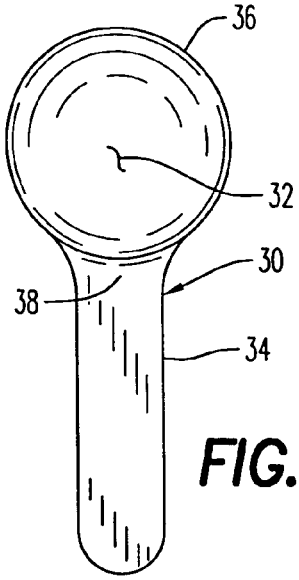
FIG. 8
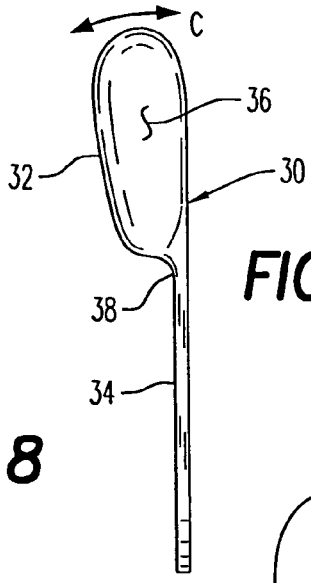
FIG. 9
FIG. 7
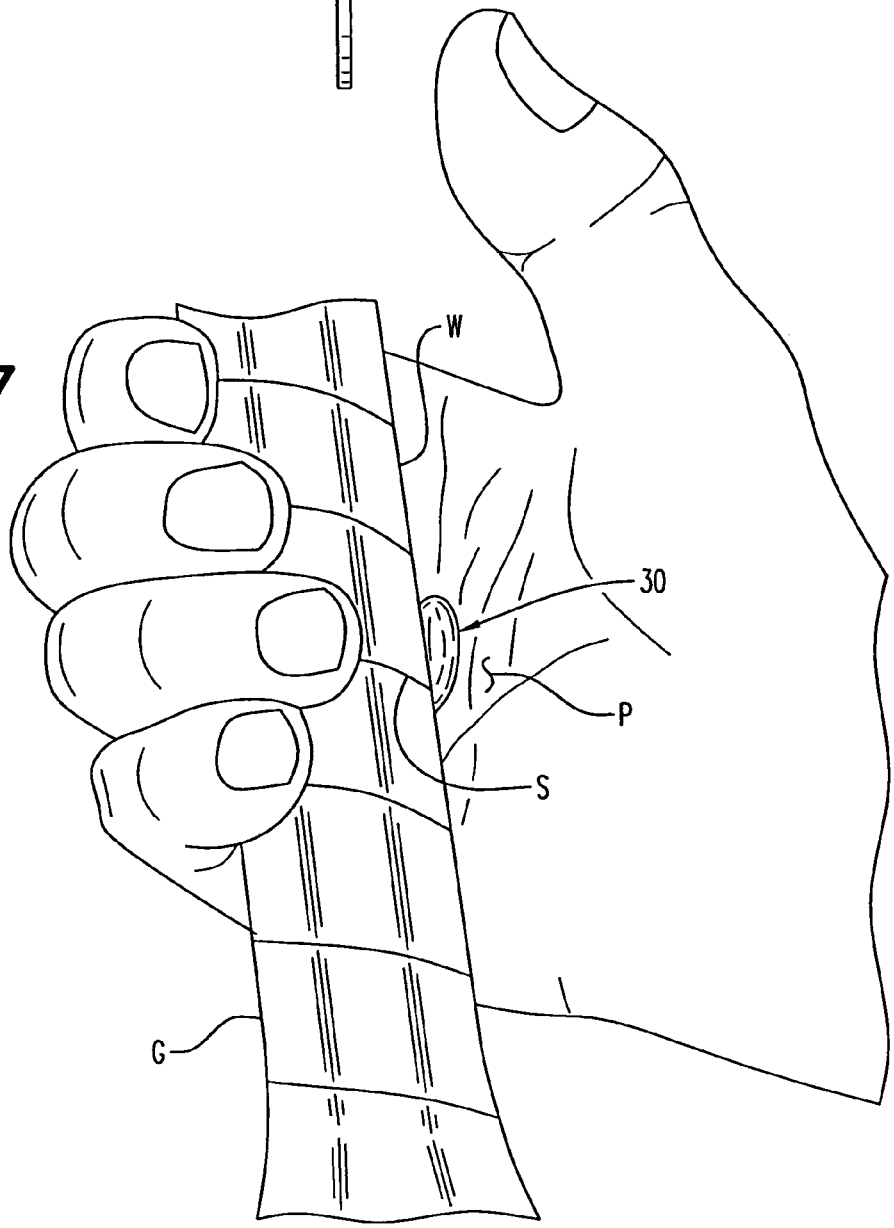

TENNIS RACKET GRIP DEVICE

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates generally to sports racket grips and more particularly to a device for filling the void between the tennis racket handle and the hand of the user and providing thumb support when the orientation of the tennis racket about the longitudinal axis of the handle is shifted for backhand shots while playing tennis.

These sports grips provide a means of training the strokes a player hits. The purpose of this invention as a training device is to provide more support for the voids in the hand or hands thus providing more power and control stroking the ball.

If the hand of a tennis player rests naturally on the handle of a tennis racket without any compensation, the racket head is slightly oriented toward the sky so that the ball will go up. To put his racket head perpendicular to the ground, the player must make compensation with his hand and arm. Players of the game of tennis utilize several different methods of gripping the racket during play to help compensate for this backhand stroke problem. Players utilize the Eastern Backhand grip, Continental grip or Western Backhand grip or grips in between these which put more of the palm to the left isde of the racket, thereby placing the racket more perpendicular to the ground. The Continental grip can also be used for serves and volleys and some players use the Continental grip for a forehand ground stroke as well as a backhand ground stroke.

A most common forehand grip is referred to as the Eastern forehand grip, which is a bit to the right of a backhand Continental grip placing the palm to the right of the handle. The racket is perpendicular to the court and the hand lies naturally on the handle.

Another solid forehand grip is referred to as the Semi-Western Forehand grip which places the palm a bit more to the right on the handle than the Eastern forehand grip. The racket head is slanted towards the ground in preparation for the ground stroke.

The Western forehand grip is common among modern players and is the grip of the great forehands. The racket strings are facing the court in preparation for this ground stroke.

2. Description of Related Art

There have been numerous attempts to assist players in the gripping of various sports rackets. U.S. Pat. No. 3,817,521 issued to Wright is directed to a thumb-stop on a tennis racket handle to facilitate gripping the racket in proper backhand position and to enable more forcibly striking a tennis ball.

A putting aid is shown in U.S. Pat. No. 3,860,243 invented by Prisco disclosing an elongated member attachable to the shaft of a golf putter to provide a means for securing better control during putting. Bertucci, in U.S. Pat. No. 4,072,311 discloses a device attachable to the handle of a tennis racket to encourage the use of the index finger for applying more power during service, forehand and backhand positions.

A handle trigger grip is disclosed by Pflueger in U.S. Pat. No. 4,402,508, which is designed to improve gripping of the racket. In U.S. Pat. No. 4,599,920, Schmid discloses a hand grip contoured as an insert to fit between the palm of the hand and the grip of the shank of the tool or sports racket to be gripped. Allsop discloses a device for positioning a person's hand on the handle of a tennis racket in U.S. Pat. No. 5,018,734. This device is intended to fit between the thumb and index finger of the user's hand.

Frost, in U.S. Pat. No. 5,180,165 discloses a hand accessory contoured to fit into the web portion of the hand and to extend down into the palm to aid in snugly gripping the handle of a piece of sport equipment or tool.

BRIEF SUMMARY OF THE INVENTION

This invention is directed to a tennis racket hand positioning device attachable to a handle of a tennis racket. In one embodiment, a saddle-shaped support member including an elongated thin attaching strip connected to and extending in spaced relation along a reverse surface of the support member. The attaching strip is adapted in width and thickness to be supportively engaged beneath a turn of handle grip wrap of the handle and against the top right bevel of the handle to support a selected position and orientation of the support member. Felt orientation indicia against the base of the thumb adjacent the palm of the user then advises of the preselected reorientation of a head of the tennis racket during a backhand stroke. Another embodiment provides support against the palm of the hand during backhand strokes and a third embodiment also provides both felt indicia and a physical stop against the base of the thumb to achieve proper preselected racket reorientation during a backhand stroke.

It is therefore an object of this invention to provide an attachment for the handle of a tennis racket which will provide felt indicia and support during axial reorientation of the handle of a tennis racket for better orientation of the racket during backhand shots.

Still another object of this invention is to provide a releasably attachable support member which provides support to the base of the thumb when the handle is quickly reoriented for backhand shots during play.

Yet another object of this invention is to provide a resilient support member which prevents over-rotation of the handle of the tennis racket during backhand shots.

Still another object of this invention is to provide a releasably attachable device attachable by interengagement beneath one turn of the textured wraps around the handle of a tennis racket for providing better reorientation of the tennis racket and stronger backhand shots while playing tennis.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 7 is a perspective view of another embodiment of the invention releasably attached to the handle of a tennis racket in use.

FIG. 8 is a front elevation view of the embodiment of the invention shown in FIG. 7.

FIG. 9 is a side elevation view of FIG. 8.

DETAILED DESCRIPTION OF THE INVENTION

Figure 4:
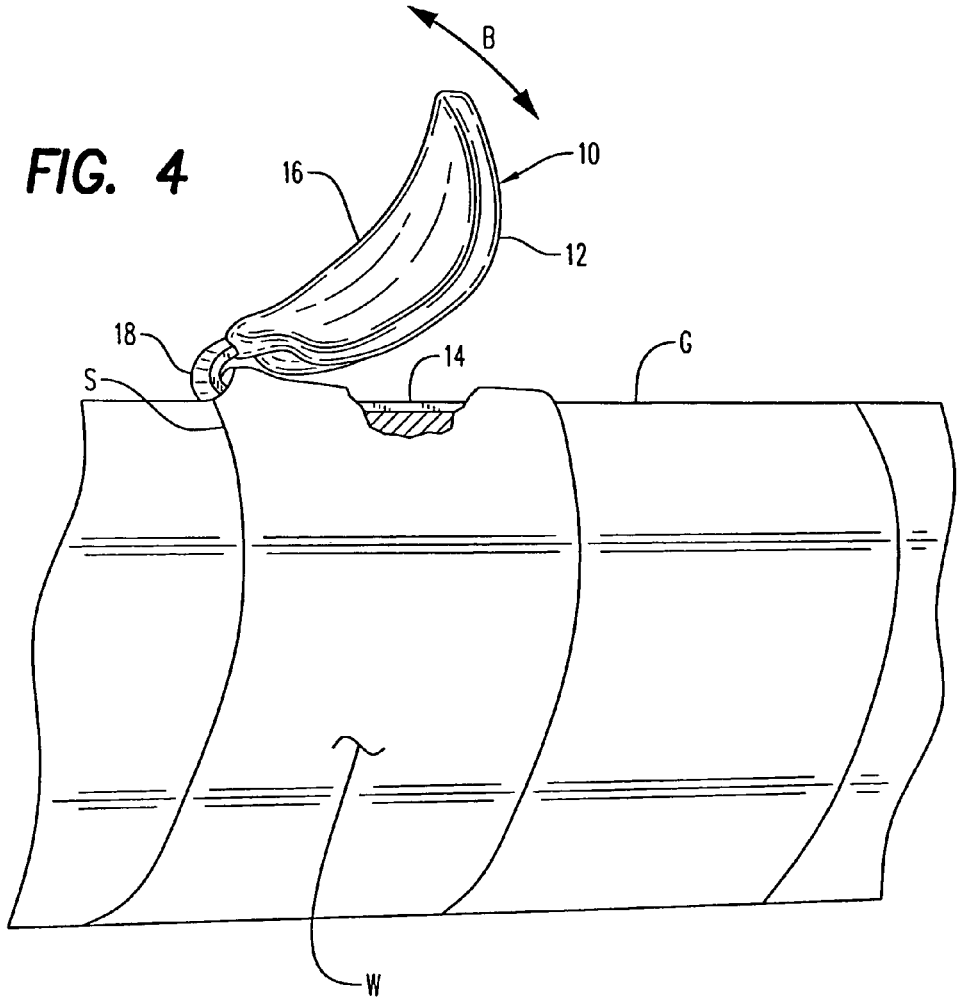
FIG. 4 is an enlarged side elevation view of FIG. 1.
Figure 5:
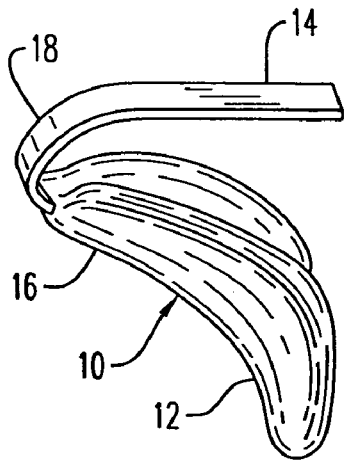
FIG. 5 is a side elevation view of the embodiment of the device shown in FIGS. 1 to 4.
Figure 6:
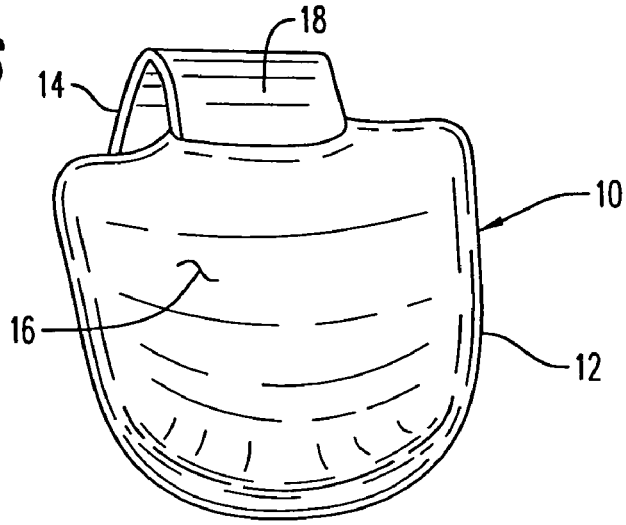
FIG. 6 is a bottom plan view of FIG. 5.
Figure 10:
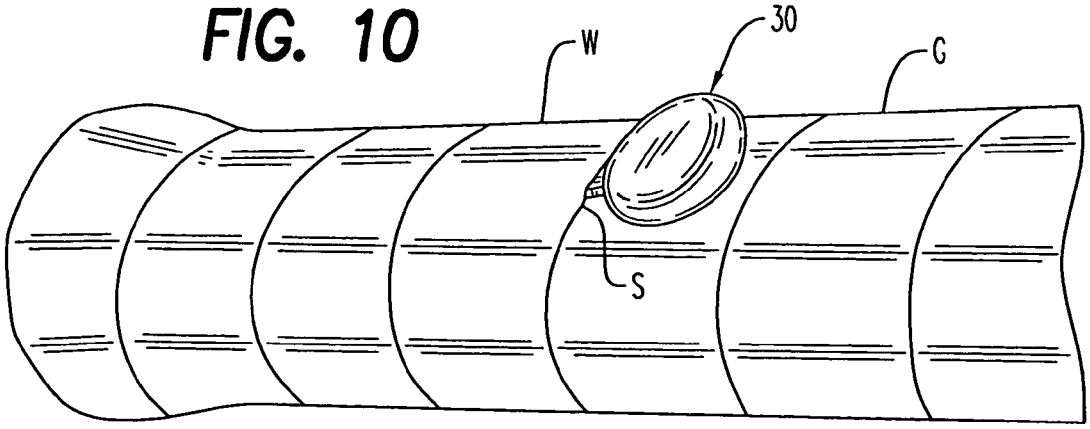
FIG. 10 is a perspective view of the invention as shown in FIG. 7.

Referring now to the drawings, and particularly to FIGS. 1 to 6, one embodiment, the preferred embodiment, is there shown generally at numeral 10. This device 10 includes a support member 12 formed of generally rigid material and coated with an elastomeric coating to provide enhanced surface contact with the hand of the user. The support member 12 has a generally saddle-shaped obverse or outwardly extending surface 16 and which is made releasably attachable to the handle G of a tennis racket shown generally at T by a resilient metallic attaching strip or tab 14. This attachment strip 14 is formed in side elevation view into a generally "V"-shaped configuration as best seen in FIG. 4.

Figure 1:
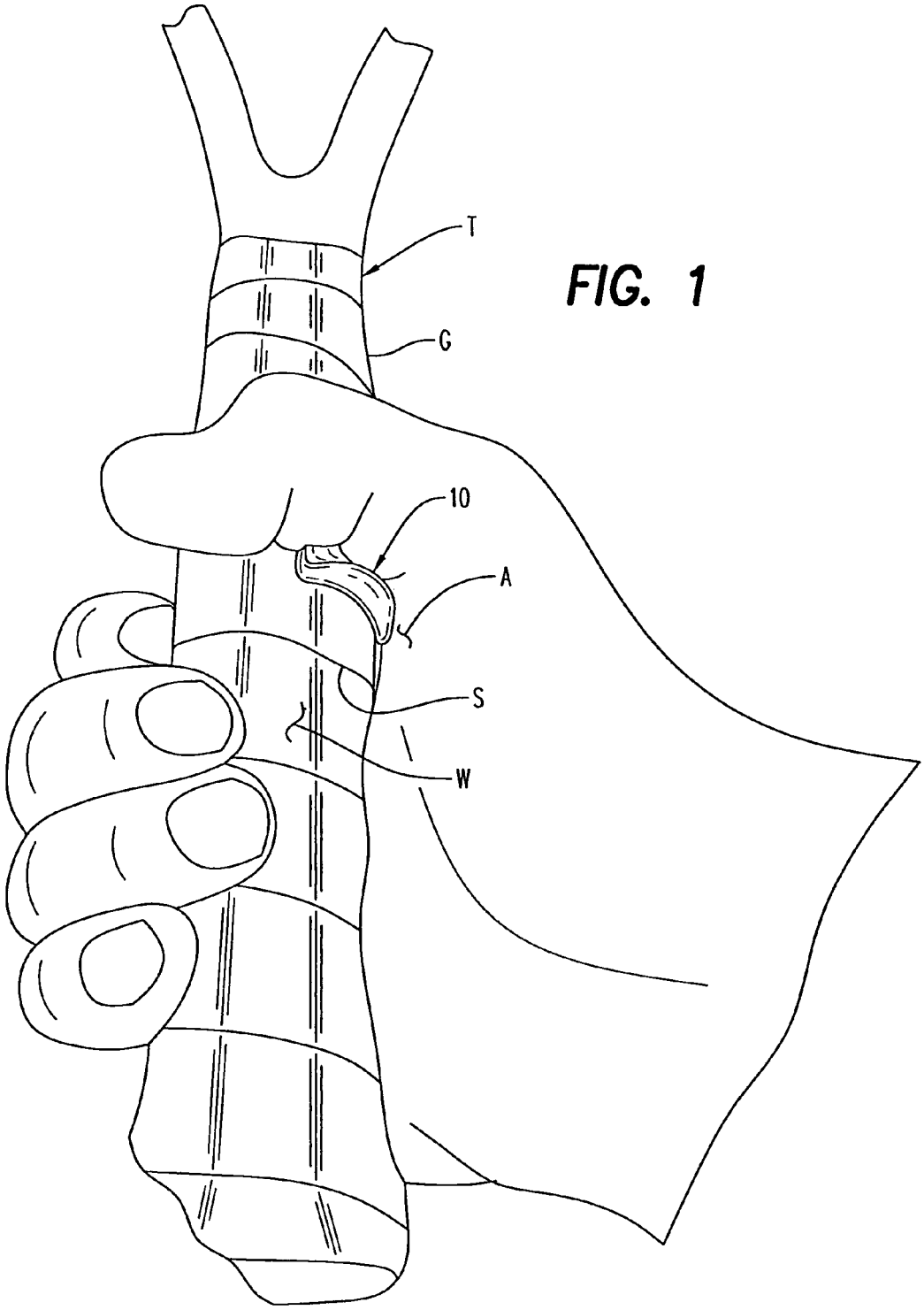
FIG. 1 is a perspective view of a handle of a tennis racket equipped with one embodiment of the invention in use.
Figure 2:
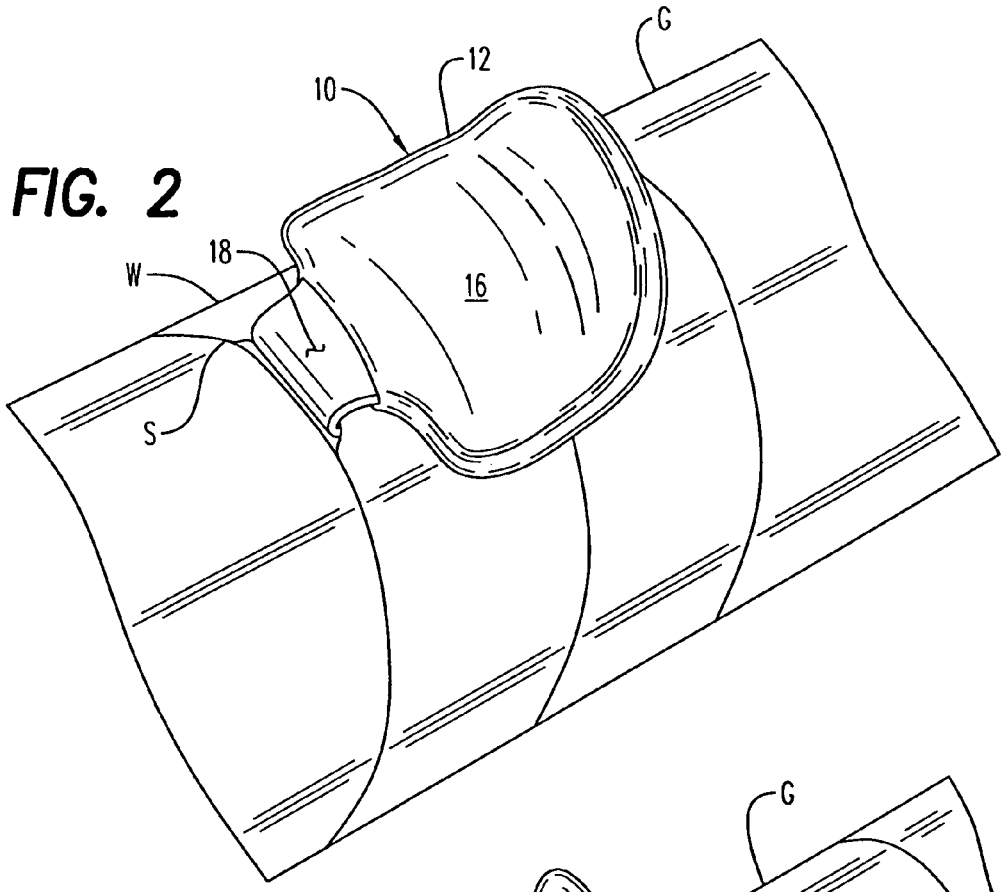
FIGS. 2 and 3 are enlarged perspective views of FIG. 1.
Figure 3:
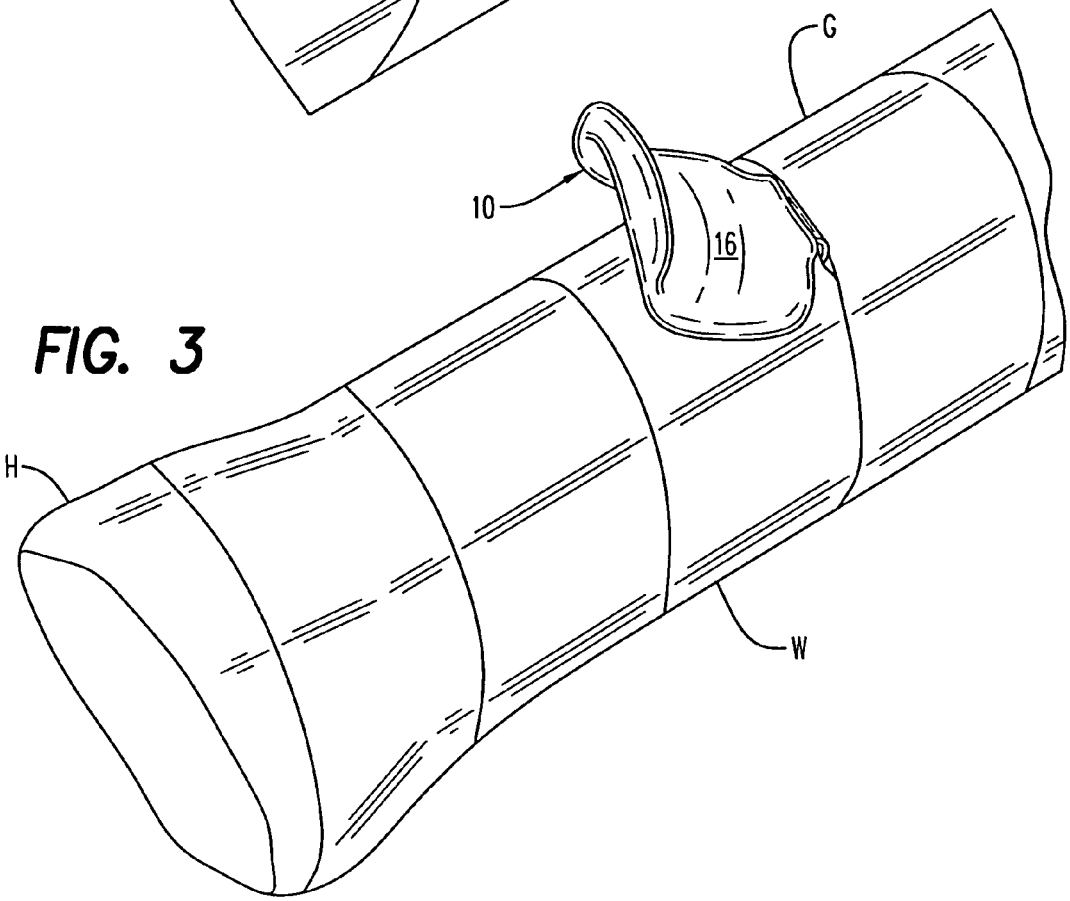

To effect releasable attachment of this device 10 to the handle G, the distal end of the attaching strip 14 is inserted into a seam S and forced beneath one wrap or turn W of the gripping material forming the outer surface of the handle G as best seen in FIG. 4. Thereafter, as best seen in FIG. 1, the device 10, having been positioned into a preselected seam and beneath a preselected wrap W, provides a positive support and felt indicia against the base of the thumb at A adjacent the palm of the hand of the user.

Figure 15:
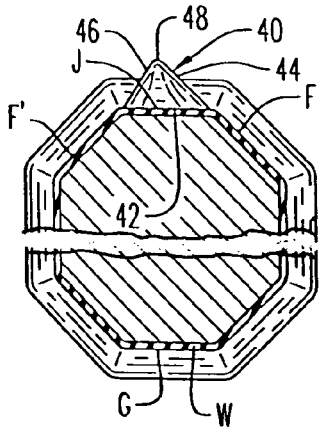
FIG. 15 is a broken sectional view in the direction of arrows 15—15 in FIG. 13.

Referring additionally to FIG. 15 generally, this device 10 has been positioned against the top right bevel F of the typically octagonal cross section of the handle G of the tennis racket T. This orientation of the device 10 against the top right or-or top left bevel F or F', respectively, of the handle G, depending on whether the player is right handed or left handed, respectively, has been selected empirically from experience to provide a proper reorientation of the handle G axially of the tennis racket T during a backhand shot or stroke whereby the head of the tennis racket T is oriented generally perpendicularly to the playing surface for better backhand shots.

The support member 12 of device 10 is somewhat angularly repositionable as best seen in FIG. 4 where the support member 12 may be angularly reoriented in the direction of arrow B by deforming the attaching strip 14 about the apex 18.

Referring to FIGS. 7 to 12, another embodiment of the invention is there shown generally at numeral 30. This embodiment 30, which is also releasably attachable to the handle G of the tennis racket T as above described, includes a generally disc-shaped palm support member 36 which may generally be described as being similar to an ellipsoid having a somewhat flattened dome-shaped obverse surface 32. An attaching strip 34 formed of resilient metal and having a width generally equal to that of a top right or top left bevel F or F' as seen in FIG. 15, is embedded into or attached at a proximal end portion thereof to the reverse surface of the palm support member 36. The entire palm support member 36 is encapsulated in a rubberized or plasticized coating for enhanced hand-surface engagement therebetween.

Figure 11:
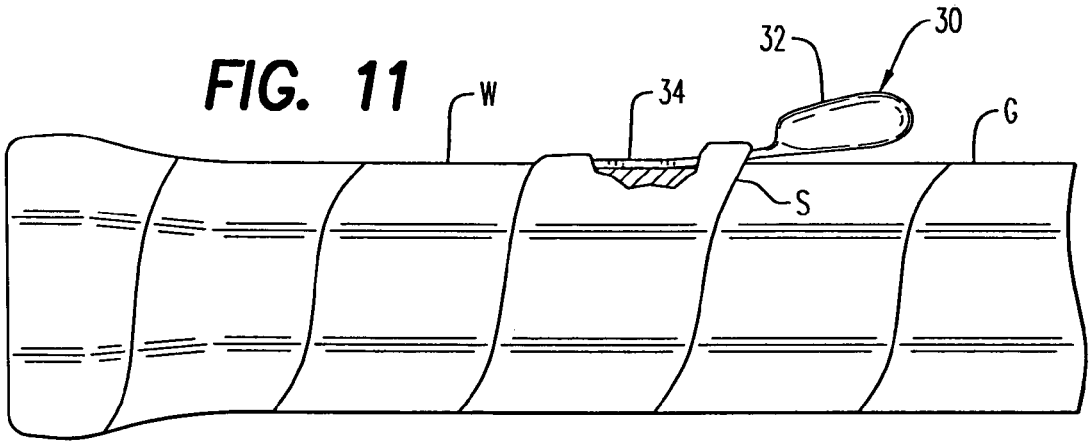
FIG. 11 is a side elevation view of FIG. 10.
Figure 12:
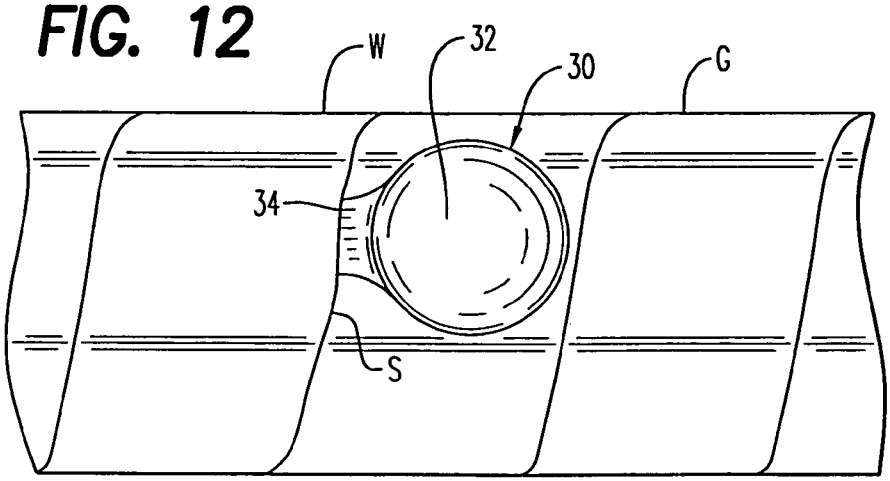
FIG. 12 is a top plan view of FIG. 10.

As best seen in FIG. 11, the attaching strip 34 is supportively insertable into a seam S appropriately selected along the length of the handle H depending on the user's hand size. By so positioning this attaching strip 34 beneath one of the wraps W of the handle G as above described, the palm support surface 32 is thereby established. In this configuration, being positioned on the right or left top bevel F or F' of the handle G, depending upon whether the player is right handed or left handed, respectively, an enlarged "button" sized palm support surface 32 is provided which compensates for the void between the handle G and palm P of the hand of a player. As best seen in FIG. 9, deformation of the attaching strip 34 at 38 will effectively alter the height of the palm support surface 32 with respect to handle G, thus providing a variable palm support member which compensates for variously configured palms P and the void normally created therebetween.

Figure 13:
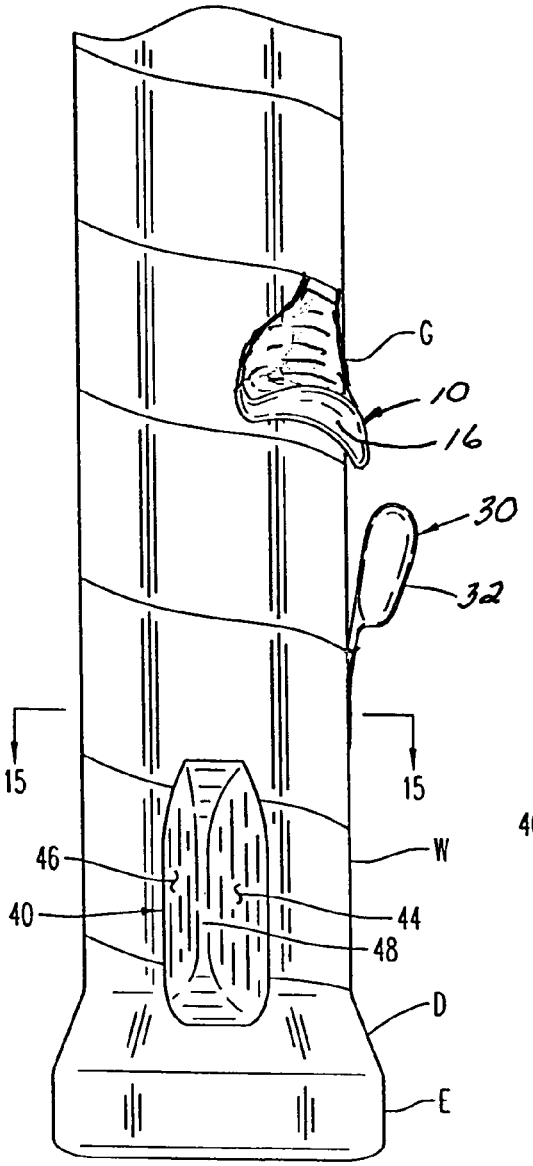
FIG. 13 is a top plan view of the handle of a tennis racket showing all embodiments of the invention attached thereto.
Figure 14:
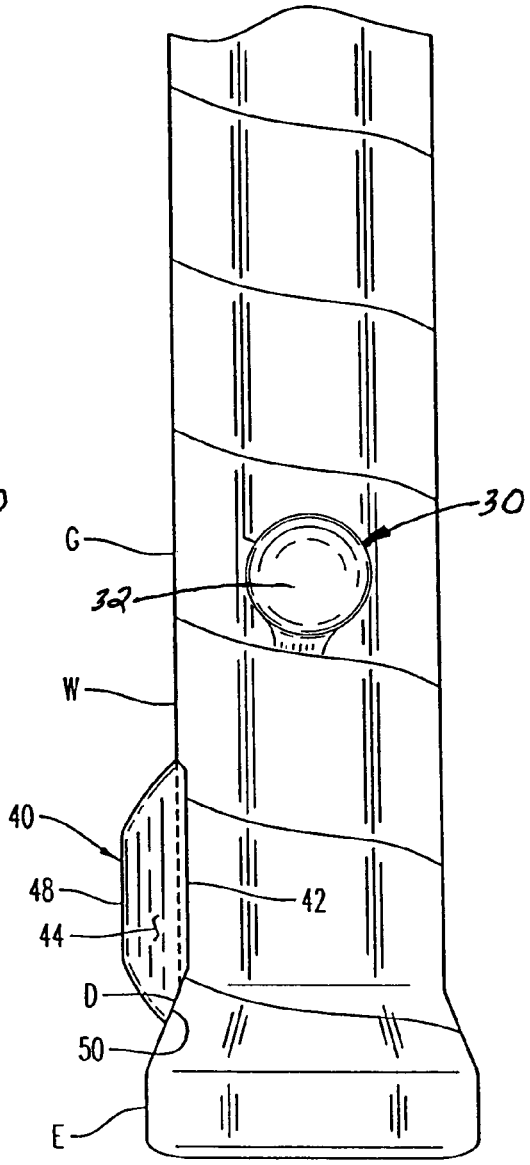
FIG. 14 is a side elevation view of FIG. 13 absent the preferred embodiment (10).

Referring now to FIGS. 13 to 15, a third embodiment of the invention is there shown generally at numeral 40 and which is formed of a molded resilient material such as silicone or polyurethane. This embodiment 40 is elongated and has a generally "A"-shaped or triangular-shaped cross section as seen in FIG. 15. This embodiment 40 is intended to be attached by adhesive or other releasably attachable means to the top bevel J of the handle G. However, it is to be understood that this embodiment 40 may also be attached to any of the tennis racket handle bevels which will suit the user's tennis playing style.

The device 40 includes a side surface 44 which is generally flat and, as best seen in FIG. 15, is generally coplanar with the top right bevel F whereby the surface of the right-handed users hand at the base of the thumb and adjacent the palm will comfortably come in contact with surface F during backhand strokes when the user wishes to rotate the tennis racket T about the axis of the handle G, again so that the head of the tennis racket T is generally upright and perpendicular to the playing surface. Note that the apex 48 which extends longitudinally of the device 40 may be shifted sideways as desired to adjust the relative widths of surfaces 44 and 46.

Note also that the reverse attaching surface 42, as best seen in FIG. 14, has an upturn at 50 at one end thereof to closely mate and align with the transitional enlarging surface D between the main portion of the handle G and the butt E of the handle. This provides a positive longitudinal positioning of the device 10 and, coupled with the intended coplanar relationship between surface 44 and the top right bevel F, renders the positioning of this embodiment 40 a precise procedure.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A tennis racket hand positioning device attachable to a handle of a tennis racket comprising:

a support member having a saddle-shaped obverse surface and including an elongated thin V-shaped attaching strip connected to and extending in spaced acute angled relation to and along a reverse surface of said support member;

said attaching strip sized in width to be similar to that of a bevel of the handle and adapted to be supportively inserted beneath a turn of handle grip wrap of the handle and against the bevel;

said obverse surface of said support member adapted to conform in shape to, and to provide felt handle orientation indicia against the base of the thumb adjacent the palm of the orientation of a head of the tennis racket.

2. A tennis racket hand positioning device as set forth in claim 1, wherein:

said attaching strip is angularly reorientable by deformation of said attaching strip whereby hand engagement of said obverse surface against the base of the thumb is selectable thereby.

3. A tennis racket hand positioning device as set forth in claim 2, wherein:

said support member has a rubberized outer coating for enhanced hand engagement thereby.

4. A tennis racket hand positioning device as set forth in claim 1, further comprising:

a disc-shaped palm support member having a flattened dome-shaped obverse surface including an elongated thin attaching strip connected to and extending radially from, and generally coplanar with a reverse surface of said palm support member;

said attaching strip of said palm support member sized in width to be similar to that of a bevel of the handle and adapted to be supportively inserted beneath a turn of handle grip wrap of the handle and against the bevel;

said palm support member having a width covering only a portion of a user's palm and adapted to be positionable along a mid portion of the length of the handle with the dome-shaped obverse surface fitting snugly into, and providing support felt and orientation indicia against the palm of the user of the reorientation of the handle and a head of the tennis racket.

5. A tennis racket hand positioning device as set forth in claim 1, further comprising:

an elongated body having an A-shaped or triangle-shaped cross section;

said body having a width similar to and attachable along a distal portion of the length of the handle atop a top bevel of the handle and having one flat side of the A-shaped or triangular-shaped obverse surface which, when positioned against and extending along a portion of the top bevel, provides felt orientation indicia against the base of the thumb of the user to advise of a preselected reorientation of the handle and racket head of the tennis racket during a backhand stroke of the tennis racket.

6. A tennis racket hand positioning device as set forth in claim 5, wherein:

said body is molded of resilient material.

7. A tennis racket hand positioning device as set forth in claim 5, wherein:

one side surface of said body which contacts the base of the user's thumb adjacent the palm is generally coplanar with a top right or left bevel of the handle, depending upon whether the user is right handed or left handed, respectively.

8. A tennis racket hand positioning device as set forth in claim 7, wherein:

one end portion of said reverse surface is contoured to fit in close alignment against, and positioned adjacent to, an enlarged butt of the handle.

9. A tennis racket hand positioning device attachable to a handle of a tennis racket comprising:

a support member having a saddle-shaped obverse surface including an elongated V-shaped attaching member connected to and extending in spaced relation at an acute angle of said support member;

said attaching member adapted to be supportively inserted beneath a turn of handle grip wrap and against a bevel of the handle;

said saddle shaped obverse surface adapted for mating engagement only with a base of the thumb adjacent the palm of the user to provide a felt indicia of handle orientation of a head of the tennis racket.

10. A tennis racket hand positioning device as set forth in claim 9, wherein:

said attaching strip is angularly reorientable by deformation of said attaching strip whereby hand engagement of said obverse surface against the base of the thumb is selectable thereby.

11. A tennis racket hand positioning device as set forth in claim 9, further comprising:

a disc-shaped palm support member having a flattened dome-shaped obverse surface including an elongated thin attaching strip connected to and extending radially from, and generally coplanar with a reverse surface of said palm support member;

said attaching strip of said palm support member sized in width to be similar to that of a bevel of the handle and adapted to be supportively inserted beneath a turn of handle grip wrap of the handle and against the bevel;

said palm support member having a width covering only a portion of a user's palm and adapted to be positionable along a mid portion of the length of the handle with the dome-shaped obverse surface fitting snugly into, and providing support felt and orientation indicia against the palm of the user of orientation of the handle and a head of the tennis racket.

12. A tennis racket hand positioning device as set forth in claim 11, further comprising:

an elongated body having an A-shaped or triangle-shaped cross section;

said body having a width similar to and attachable along a distal portion of the length of the handle atop a top bevel of the handle and having one flat side of the A-shaped or triangular-shaped obverse surface which, when positioned against and extending along a portion of the top bevel, provides felt orientation indicia against the base of the thumb of the user to advise of a preselected reorientation of the handle and racket head of the tennis racket during a backhand stroke of the tennis racket.

13. A tennis racket hand positioning device as set forth in claim 9, further comprising:

an elongated body having an A-shaped or triangle-shaped cross section;

said body having a width similar to and attachable along a distal portion of the length of the handle atop a top bevel of the handle and having one flat side of the A-shaped or triangular-shaped obverse surface which, when positioned against and extending along a portion of the top bevel, provides felt orientation indicia against the base of the thumb of the user to advise of a preselected reorientation of the handle and racket head of the tennis racket during a backhand stroke of the tennis racket.

* * * * *